US009216587B2

(12) United States Patent
Ando et al.

(10) Patent No.: US 9,216,587 B2
(45) Date of Patent: Dec. 22, 2015

(54) LIQUID EJECTING APPARATUS

(71) Applicant: SEIKO EPSON CORPORATION, Tokyo (JP)

(72) Inventors: Masaaki Ando, Nagano (JP); Kaoru Koike, Aichi (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/484,668

(22) Filed: Sep. 12, 2014

(65) Prior Publication Data

US 2015/0085032 A1 Mar. 26, 2015

(30) Foreign Application Priority Data

Sep. 20, 2013 (JP) ..... 2013-194740

(51) Int. Cl.
*B41J 2/185* (2006.01)

(52) U.S. Cl.
CPC ..... *B41J 2/185* (2013.01)

(58) Field of Classification Search
CPC .... B41J 2/185; B41J 2/175; B41J 2002/1853; B41J 2/18; B41J 2/19
USPC ..... 347/85, 90
See application file for complete search history.

(56) References Cited

U.S. PATENT DOCUMENTS 4,010,477 A * 3/1977 Frey ..... 347/74
7,992,955 B2 * 8/2011 Takata ..... 347/18
2004/0085416 A1 * 5/2004 Kent ..... 347/89
2004/0263585 A1 * 12/2004 Jeanmaire ..... 347/74
2006/0203047 A1 * 9/2006 Koga et al. ..... 347/85
2009/0009553 A1 * 1/2009 Hosono ..... 347/29
2009/0225123 A1 * 9/2009 Katoh ..... 347/17
2010/0134571 A1 * 6/2010 Shimizu ..... 347/85
2011/0080456 A1 4/2011 Shibata et al.
2012/0026262 A1 * 2/2012 Shimizu ..... 347/93
2012/0188316 A1 * 7/2012 Matsuoka et al. ..... 347/89
2012/0218355 A1 * 8/2012 Suzuki et al. ..... 347/54

FOREIGN PATENT DOCUMENTS

JP 2011-079169 A 4/2011

* cited by examiner

*Primary Examiner* — Matthew Luu
*Assistant Examiner* — Patrick King
(74) *Attorney, Agent, or Firm* — Global IP Counselors, LLP

(57) ABSTRACT

A liquid circulation part has a recovery path where a liquid flows into a retaining part from a first head and a second head. The recovery path has a first merging point where the liquid flowing from the first head and the liquid flowing from the second head are merged, a first recovery path part where the liquid flowing from the first head flows into the first merging point, and a second recovery path part where the liquid flows from the first merging point. The cross-sectional area of the second recovery path part, orthogonal to a direction of flow of the liquid in the second recovery path part, is greater than the cross-sectional area of the first recovery path part, orthogonal to the direction of flow of the liquid in the first recovery path part.

7 Claims, 5 Drawing Sheets

LIQUID EJECTING APPARATUS

CROSS-REFERENCE TO RELATED APPLICATIONS

This application claims priority to Japanese Patent Application No. 2013-194740 filed on Sep. 20, 2013. The entire disclosure of Japanese Patent Application No. 2013-194740 is hereby incorporated herein by reference.

BACKGROUND

1. Technical Field

The present invention relates to a liquid ejecting apparatus provided with a plurality of heads for ejecting a liquid, and, in particular, to a technique for circulating a liquid through a plurality of heads.

2. Related Art

One known example of this type of liquid ejecting apparatus is an inkjet recording apparatus disclosed in Japanese laid-open patent publication 2011-79169. With this apparatus, ink supplied from an ink tank is distributed with an ink supply manifold. More specifically, the ink is distributed and supplied to respective head modules via a first branching flow path extending from the ink supply manifold. In turn, ink that is discharged from each of the head modules is recovered in an ink recovery manifold via a second branching flow path, and moreover is returned to the ink tank from the ink recovery manifold. This constitutes an ink circulation system with which ink is supplied from an ink tank and passes through a plurality of heads, and the ink is again recovered in the ink tank.

In the apparatus disclosed in Japanese laid-open patent publication 2011-79169, both the ink supply manifold and the ink recovery manifold have provided therein an internal flow path sufficiently thick enough for gas and the ink to separate up and down when there is admixed gas in the ink. Here, provided that the cross-sectional areas of the internal flow paths are constant, then the pressure loss varies every instance of passage through the branching flow paths. In particular, the recovery side (also called the return side) is majorly impacted by the pressure fluctuations, and this leads to a decrease in the ejection performance of the liquid. That is to say, both of the internal flow paths have a constant flow path resistance in a case where the internal flow path of the ink recovery manifold has a constant cross-sectional area. Therefore, at every instance of passage through the second branching flow path, the flow rate inside the internal flow path increases and the pressure loss grows. As a result, the pressure on the meniscus of the nozzles of each of the heads varies greatly and every head ends up having a different ejection of liquid.

SUMMARY

A purpose of the present invention is to provide a feature for equalizing the pressure applied to a plurality of heads in a liquid ejecting apparatus for ejecting a liquid from each of the heads while the liquid is being circulated through each of the heads.

A liquid ejecting apparatus according to one aspect of the invention is provided with a retaining part configured to retain a liquid, a first and second heads configured to eject the liquid, and a liquid circulation part where the liquid flows from the retaining part through the first head to the retaining part, and where the liquid passes from the retaining part through the second head to the retaining part. The liquid circulation part has a recovery path where the liquid flows to the retaining part from the first head and the second head, and the recovery path has a first merging point where the liquid flowing from the first head and the liquid flowing from the second head merge together, a first recovery path part where the liquid flowing from the first head flows to the first merging point, and a second recovery path part where the liquid flows from the first merging point. The cross-sectional area of the second recovery path part, which is orthogonal to a direction of flow of the liquid at the second recovery path part, is greater than the cross-sectional area of the first recovery path part, which is orthogonal to a direction of flow of the liquid at the first recovery path part.

With the invention thus configured, the liquid recovered from the second head is merged at the first merging point into the liquid that has flowed to the first merging point from the first recovery path part, and thereafter flows toward the retaining part from the second recovery path part along with the liquid recovered from the first head. As such, the flow rate of the liquid flowing through the second recovery path part is greater than the flow rate of the liquid flowing through the first recovery path part. Here, in a case where the first recovery path part and the second recovery path part have the same cross-sectional area, then there will be greater fluctuation in the pressure at the second head, which leads to the second recovery path part. Therefore, in the present invention, having the cross-sectional area of the second recovery path part be greater than the cross-sectional area of the first recovery path part lowers the flow path resistance of the second recovery path part and curbs the above-mentioned fluctuation in pressure. As a result, it is possible to even the pressure imparted to the first head and the second head.

Here, it is desirable to configure as described above in a case where the liquid ejecting apparatus is provided with a third head configured to eject the liquid, and liquid recovered from the third head is merged at a second merging point into liquid (liquid recovered from the first head and the second head) having flowed from the second recovery path part, and thereafter flows toward the retaining part from a third recovery path part. Namely, in a preferred configuration, the cross-sectional area of the third recovery path part, which is orthogonal to a direction of flow of the liquid at the third recovery path part, is greater than the cross-sectional area of the second recovery path part, which is orthogonal to the direction of the flow of the liquid at the second recovery path part. Though the flow rate of the liquid flowing through the third recovery path part is greater, so doing does lower the flow path resistance of the third recovery path part, and therefore makes it possible to curb the fluctuation in pressure at the third head which leads to the third recovery path part. As a result, it is possible to even the pressure imparted to not only of the first head and the second head, but also to the third head.

As a specific means for adjusting the cross-sectional area, for example, it suffices for the width and/or the depth of a cross-section orthogonal to the direction of flow of the liquid at each of the recovery path parts to be different among the plurality of the recovery path parts. In consideration of making it easier to mold the liquid circulation part and in particular the recovery paths, of improving the molding precision, and the like, however, it is desirable to have one out of the width and depth of the cross-sections be equal and have the other be mutually different.

In the invention, the cross-sectional area of the recovery path parts that are upstream and downstream relative to the merging parts are made to be mutually different, but the cross-sectional area of each of the recovery path parts is at will. For example, a stepped difference is formed at the merging points in a case where the recovery path parts are given a constant cross-sectional area in the direction of flow of the liquid at each of the recovery path parts. As such, the flow of the liquid changes greatly at the merging points of a shape having a stepped difference, and a disturbance is produced in the flow. In an apparatus for ejecting, for example, a white ink comprising a highly settleable substance as the liquid, the above-mentioned disturbance produces the effect of making it easier to recover the settling.

However, the configuration may be such that the cross-sectional area of each of the recovery path parts increases continuously in the direction of flow of the liquid at the relevant recovery path part. In such a case, it is possible to curb the occurrence of the above-mentioned disturbance.

Furthermore, in an apparatus with which the liquid circulation part has a supply path configured to supply the liquid to the first head and the second head from the retaining part, it would be possible for the supply path to be constituted of a first branching point configured to branch the liquid being supplied to the first head from the liquid being supplied from the retaining part, a first supply path part configured to cause the liquid to flow to the first branching point, and a second supply path part configured to cause the liquid that was not branched at the first branching point to flow from the first branching point. In such a case, a change in the flow rate of the liquid is observed at before and after the passage through the first branching point. Here, in a case where the first supply path part and the second supply path part have the same cross-sectional area, there occurs a fluctuation in the pressure at the second head leading to the second supply path part. Therefore, the flow path resistance of the second recovery path part may be increased and the above-mentioned fluctuation in pressure curbed by having the cross-sectional area of the second supply path part be smaller than the cross-sectional area of the first supply path part. This makes it possible to even more favorably even the pressure imparted to the first head and the second head.

BRIEF DESCRIPTION OF THE DRAWINGS

Referring now to the attached drawings which form a part of this original disclosure.

DETAILED DESCRIPTION OF EXEMPLARY EMBODIMENTS

Figure 1:
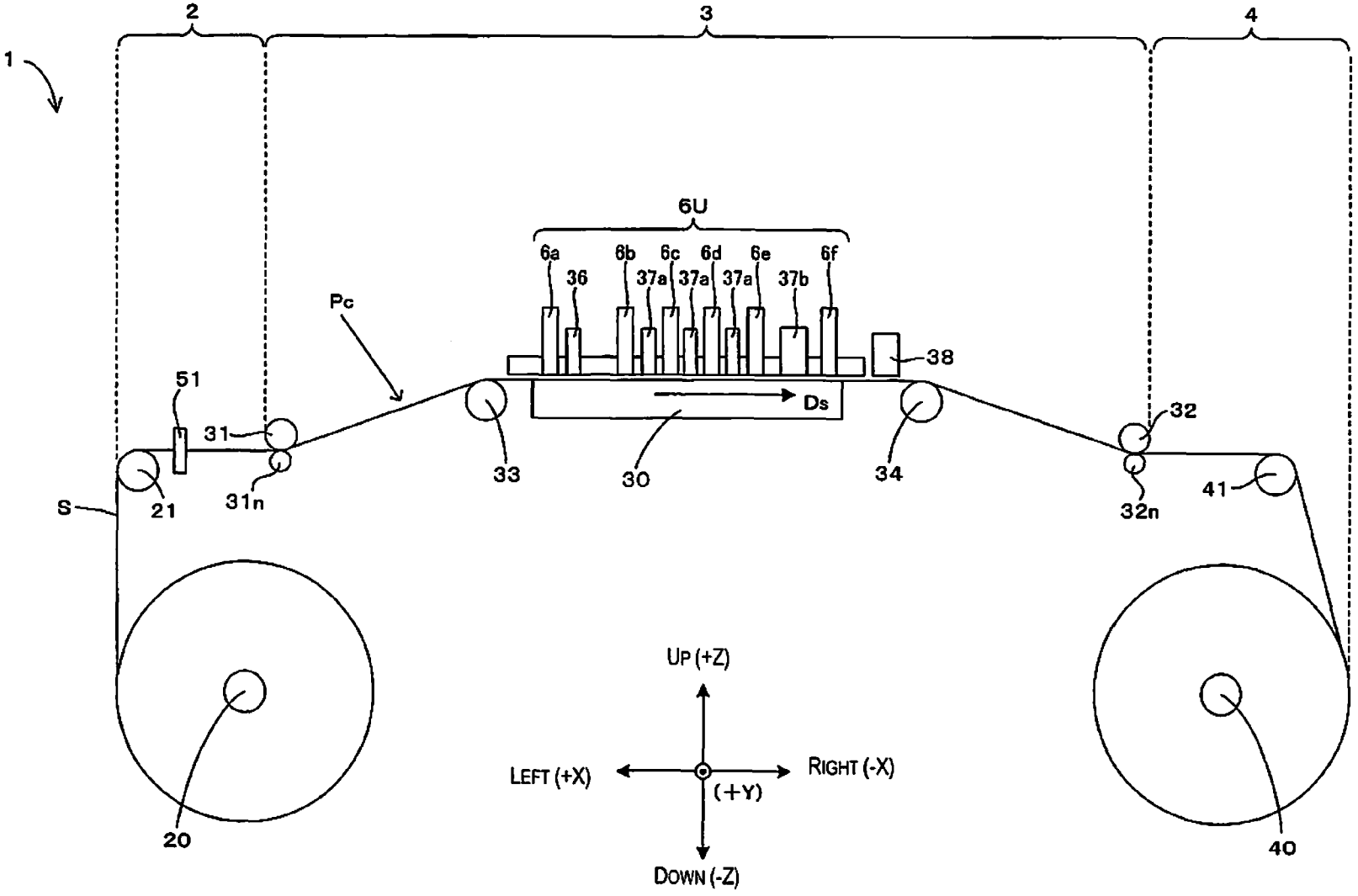
FIG. 1 is a front view schematically illustrating the configuration of a printer to which the present invention can be applied.

FIG. 1 is a front view schematically illustrating the configuration of a printer to which the present invention can be applied. In FIG. 1 and subsequent drawings, in order to clarify the relationships of arrangement among the respective parts of a printer 1, a three-dimensional coordinate system corresponding to a left-right direction X, front-rear direction Y, and vertical direction Z of the printer 1 shall be employed.

As illustrated in FIG. 1, the printer 1 has a feed-out part 2, a process part 3, and a take-up part 4 that are arrayed in the left-right direction. The feed-out part 2 and the take-up part4 include a feed-out spindle 20 and a take-up spindle 40, respectively. Two ends of a sheet S (medium) are wound in the form of a roll around the feed-out part 2 and the take-up part 4, the sheet S being stretched therebetween. The sheet S is conveyed to the process part 3 from the feed-out spindle 20 along a path of conveyance Pc on which the sheet S is thus stretched, and, after undergoing an image recording process by a print unit 6U, is conveyed toward the take-up spindle 40. The type of the sheet S is largely divided into paper-based and film-based. In the following description, whichever side of the two sides of the sheet S is the one on which the image is recorded is referred to as the "(front) surface", while the side opposite thereto is referred to as the "reverse surface".

The feed-out part 2 has the feed-out spindle 20, around which an end of the sheet S has been wound, as well as a driven roller 21 around which the sheet S having been drawn out from the feed-out spindle 20 is wound. When the feed-out spindle 20 rotates, the sheet S wound around the feed-out spindle 20 is thereby fed out toward the process part 3 by way of the driven roller 21.

The process part 3 uses the print unit 6U to record an image onto the sheet S while also supporting the sheet S, having been fed out from the feed-out part 2, with a platen 30. That is, the print unit 6U has a plurality of heads 6 arranged side by side along the surface of the platen 30, and when the heads 6 eject ink onto the sheet S being supported on the surface of the platen 30, the image is thereby recorded onto the sheet S. In the process part 3, a front drive roller 31 and a rear drive roller 32 are provided to both ends of the platen 30, and the sheet S, which is conveyed from the front drive roller 31 to the rear drive roller 32, is supported on the platen 30 and subjected to the printing of an image.

Driven rollers 33, 34 are provided to the left and right sides of the platen 30, and the driven rollers 33, 34 wind up, from the reverse surface side, the sheet S being conveyed from the front drive roller 31 toward the rear drive roller 32.

A nip roller 31*n* is provided for the front drive roller 31. This nip roller 31*n* enables reliable conveyance by the front drive roller 31, by nipping the sheet S against the front drive roller 31. Likewise, a nip roller 32*n* is provided for the rear drive roller 32.

The sheet S being conveyed from the front drive roller 31 toward the rear drive roller 32 in this manner is conveyed in a conveyance direction Ds over the platen 30 while being supported by the platen 30. In the process part 3, the plurality of heads 6 for ejecting the ink in an inkjet format onto the front surface of the sheet S being supported by the platen 30 are arranged side by side in the direction of conveyance Ds while also facing the front surface of the platen 30. In each of these heads 6, a plurality of nozzles are arranged side by side in a rectilinear shape in the Y-direction, orthogonal to the direction of conveyance Ds, thus forming a nozzle column, and a plurality of columns of the nozzles are arranged side by side spaced apart by an interval in the direction of conveyance Ds. As such, each of the heads 6 can record a plurality of line images at the same time. The heads 6 eject the ink of the corresponding color in an inkjet format, while also leaving a slight clearance in facing the front surface of the sheet S supported on the platen 30.

The color ink heads 6 of these heads eject a yellow (Y), cyan (C), magenta (M), or black (K) ink, respectively, to form the color image. A head 6 that is disposed further upstream (to the left-hand side in FIG. 1) in the direction of conveyance Ds than the color ink heads 6 is for ejecting a white (W) ink, and prints a background (hereinafter called the "background image") of the color image formed by the color ink heads 6. A head 6 that is disposed further downstream (to the right-hand side in FIG. 1) in the direction of conveyance Ds than the color ink heads 6 is for ejecting a transparent ink; the transparent ink is further ejected onto the color image and the background image.

Here, the ink used is a UV (ultraviolet) ink that is cured by being irradiated with ultraviolet rays (light) (i.e., is a photocurable ink). Therefore, provided in the present embodiment are a background image UV lamp 36, color image UV lamps 37*a*, 37*b*, and a transparent ink UV lamp 38. That is, the UV lamps 36, 37*a*, 37*b*, 38 cure each of the inks and fix same to the sheet S.

In this manner, in the process part 3, the sheet S supported on the platen 30 is subjected as appropriate to the ejecting and curing of the ink, and, for example, the formation of a color image provided with a background image coated with the transparent ink. The sheet S on which the color image has been formed is then conveyed toward the take-up part 4 by the rear drive roller 32.

The take-up part 4 includes the take-up spindle 40 around which the end of the sheet S is wound, and a driven roller 41 around which the sheet S being conveyed toward the take-up spindle 40 is wound. When the take-up spindle 40 is rotated, the sheet S is thereby wound around the take-up spindle 40, passing by way of the driven roller 41.

Figure 2:
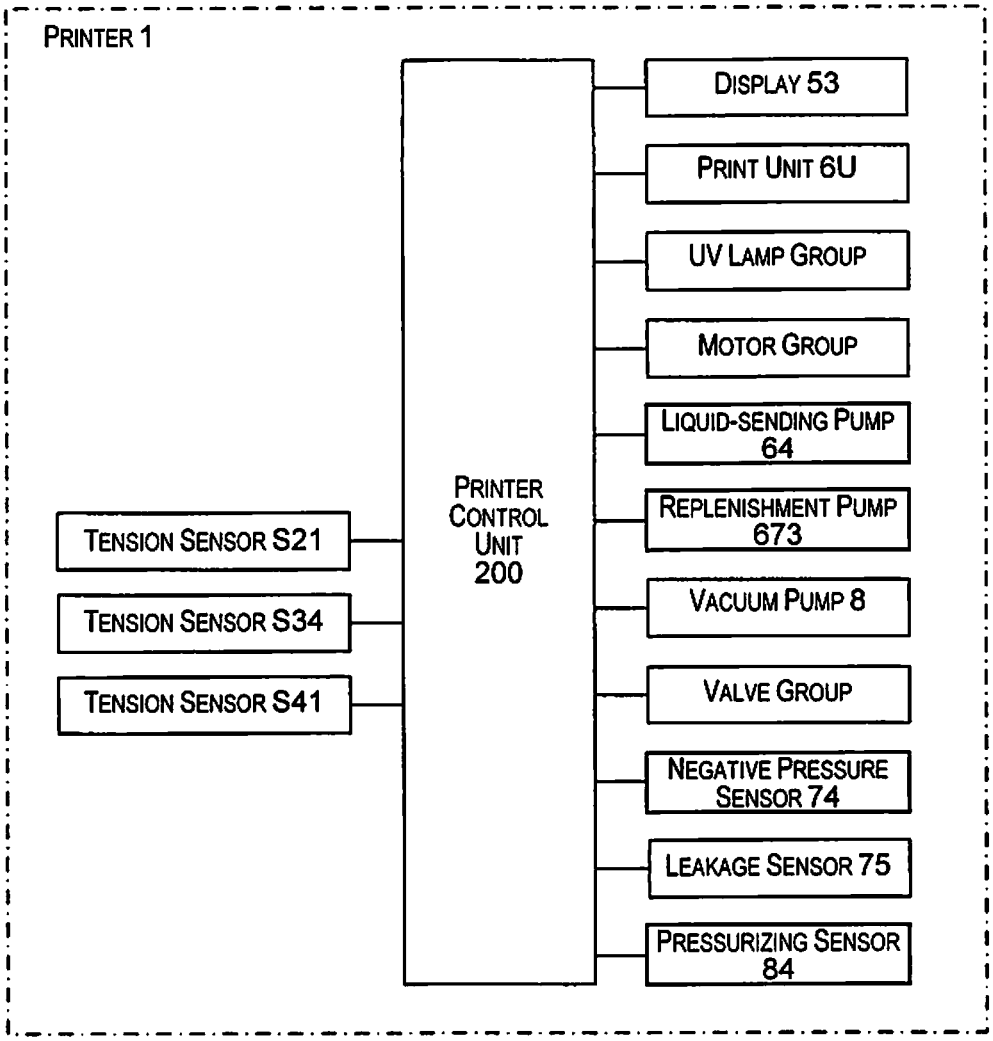
FIG. 2 is a block diagram schematically illustrating an electrical configuration for controlling the printer illustrated in FIG. 1.

The foregoing is a summary of the mechanical configuration of the printer 1. The following description shall relate to the electrical configuration for controlling the printer 1. FIG. 2 is a block diagram schematically illustrating the electrical configuration for controlling the printer illustrated in FIG. 1. In the printer 1, a printer control unit 200 for controlling each of the parts of the printer 1 in accordance with a command from an external host computer 10 is also provided. Each of the apparatus parts for the heads, the UV lamps, the sheet conveyance system, and the ink supply system are then controlled by the printer control unit 200. The details of the manner in which the printer control unit 200 controls each of the apparatus parts are as follows.

The printer control unit 200 governs a function for controlling the conveyance of the sheet S, described in detail with reference to FIG. 1. In other words, among the members constituting the sheet conveyance system, a motor is respectively connected to the feed-out spindle 20, the front drive roller 31, the rear drive roller 32, and the take-up spindle 40. The printer control unit 200 controls the speed and torque of each of the motors while also causing this group of motors to rotate, thus controlling the conveyance of the sheet S.

Furthermore, the printer control unit 200 controls the operation of the heads 6 of the print unit 6U as well as the operation of the UV lamps 36, 37*a*, 37*b*, 38 in accordance with the circumstances of conveyance of the sheet S on the platen 30.

Also provided to the printer 1 is a display 53 serving as a user interface. The display 53 is constituted of a touch panel, and in addition to a display function for effectuating a display for the user, also is responsible for an input function for receiving an input coming from the user. The printer control unit 200 displays a variety of items of information and commands on the display 53, and controls each of the parts of the printer 1 in accordance with the input coming from the user.

Figure 3:
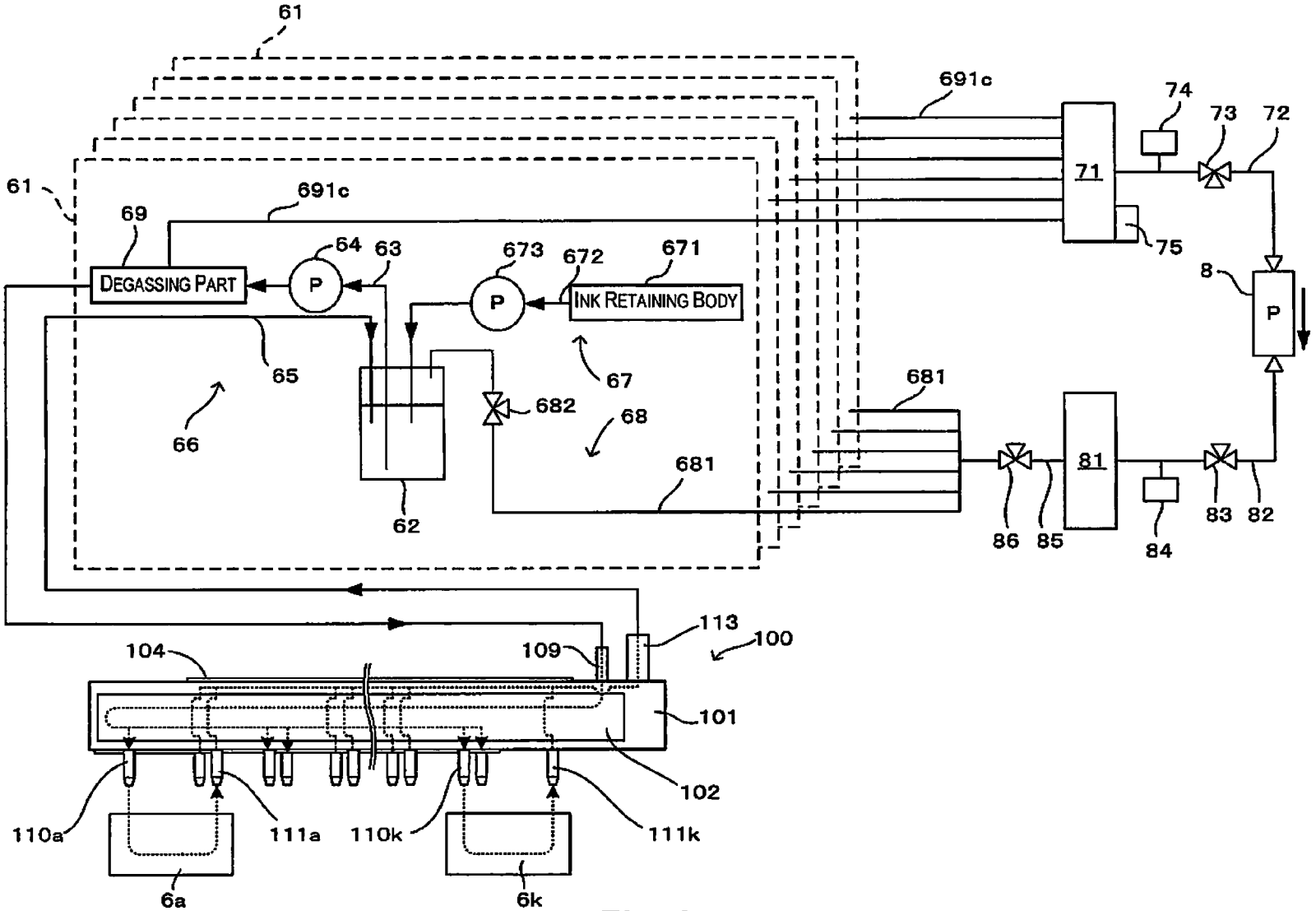
FIG. 3 is a drawing schematically illustrating an example of the configuration of a supply system for supplying ink to a head.

Next, an example of the configuration of the ink supply mechanism with which the printer 1 is equipped shall be described. FIG. 3 is a drawing for schematically illustrating an example of a configuration of a supply system for supplying the inks to the heads. In the ink supply mechanism, there is for each of the colors of ink an ink supply part 1 for controlling the supply of ink in accordance with an operation command of the printer control unit 200. These six ink supply parts 61 have basically the same configuration. That is to say, the ink supply parts 61 have a tank 62 (corresponding to a "retaining part" of the invention) for retaining the ink, a supply flow path 63 (supply tube) for connecting the tank 62 and a manifold 100 together, a liquid-sending pump 64 provided to the supply flow path 63, and a recovery flow path 65 (recovery tube) for connecting the manifold 100 and the tank 62 together. This forms a circulation pathway 66 which functions as a "liquid circulation part" of the invention and on which the ink flows through the tank 62, the supply flow path 63, the manifold 100, the recovery flow path 65, and the tank 62, in the stated order.

The manifold 100 is provided for every color of ink, similarly to how the ink supply parts 61 are respectively provided so as to correspond to the heads 6 for the white ink, for the four colors of color ink, and for the transparent ink. For example, as the head 6 for the white ink, a plurality (11, in the present embodiment) of heads are provided and these heads 6 are connected to a manifold 100 for the white ink. The manifold 100 has a function for splitting the white ink that is supplied via the supply flow path 63 by the number of heads 6 for white and supplying same to each of the heads 6, and a mechanism for merging the white ink recovered from each of the heads 6 into the recovery flow path 65 and feeding same out to the tank 62. The manifolds 100 for the other colors of ink also have the same configuration as that of the manifold 100 for the white ink. The configurations and operations of the manifolds 100 shall be described in greater detail below.

The description again relates to FIG. 3, and continues to describe the configuration of the ink supply parts 61. The ink supply parts 61 further have an ink replenishment mechanism 67 for replenishing the tank 62 with ink, and a pressure adjustment mechanism 68 for adjusting the pressure inside the tank 62. The ink replenishment mechanism 67 has an ink retaining body 671 such as an ink cartridge or ink pack, a replenishment flow path 672 (replenishment tube) that connects the ink retaining body 671 and the tank 62 together, and a replenishment pump 673 provided to the replenishment flow path 672. The replenishment pump 673 rotates in the forward direction accordance with a replenishment command coming from the printer control unit 200, and the tank 62 is thereby replenished with ink that is inside the ink retaining body 671 via the replenishment flow path 672.

The pressure adjustment mechanism 68 has a pressurizing pathway (pressurizing piping) 681 that connects a pressurizing buffer tank (described below) and the tank 62 together, and a three-way valve 682 provided to the pressurizing pathway 681. The three-way valve 682 is actuated in accordance with a valve switch command coming from the printer control unit 200, and the pressure inside the tank 62 is thereby adjusted. Namely, the three-way valve 682 has a function for switching between a pathway that goes to the tank 62 from the pressurizing buffer tank (described below) and a pathway for introducing air into the tank 62; each of the pathways is selectable in accordance with the switch command coming from the printer control unit 200. For example, at the time of a switch to the pathway going from the pressurizing buffer tank to the tank 62, the tank 62 is pressurized by a positive pressure that has accumulated in the pressurizing buffer tank, thus raising the pressure inside the tank 62. Conversely at the time of a switch to the pathway for introducing air into the tank 62, the inside of the tank 62 is returned to atmospheric pressure.

Further provided is a degassing part 69, in order for the ink supply part 61 to remove gaseous components such as bubbles included in the ink. Namely, in addition to the liquid-sending pump 64, the degassing part 69 is provided to the supply flow path 63, to the downstream side in the ink supply direction relative to the liquid-sending pump 64, and a degassing unit is used to degas the ink supplied to the heads 6.

Each of the degassing parts 69, as illustrated in FIG. 3, is connected to a depressurizing buffer tank 71 via a negative pressure supply pathway 691*c*. The depressurizing buffer tank 71 has, for example, a columnar shape, and a negative pressure can be accumulated in an interior space thereof. The depressurizing buffer tank 71 is connected to a vacuum pump 8 by a negative pressure introduction pathway (piping) 72. A three-way valve 73 is provided to the negative pressure introduction pathway 72. The three-way valve 73 has a function for switching between a pathway going from the depressurizing buffer tank 71 to the vacuum pump 8 and a pathway for introducing air to the vacuum pump 8; each of the pathways is selectable in accordance with a switch command coming from the printer control unit 200. For example, at the time of a switch to the pathway going from the depressurizing buffer tank 71 to the vacuum pump 8, the air inside the depressurizing buffer tank 71 is suctioned by the vacuum pump 8 and the pressure of the interior space of the depressurizing buffer tank 71 is reduced. At the time of a switch to the pathway for introducing air to the vacuum pump 8, however, the depressurization of the depressurizing buffer tank 71 by the vacuum pump 8 is stopped. A negative pressure sensor 74 is provided in order to measure the pressure inside the depressurizing buffer tank 71. A leakage sensor 75 is disposed so as to face laterally below the depressurizing buffer tank 71, and when ink has flowed into the interior space of the depressurizing buffer tank 71, the leakage sensor 75 makes it possible to detect ink leakage.

In the present embodiment, beyond the depressurizing buffer tank 71, also provided is a pressurizing buffer tank 81. The pressurizing buffer tank 81 has the same structure as that of the depressurizing buffer tank 71, and a positive pressure can be accumulated in an interior space thereof. In other words, the pressurizing buffer tank 81 is connected to the vacuum pump 8 by a pressurizing introduction pathway (piping) 82. A three-way valve 83 is provided to the pressurizing introduction pathway 82. The three-way valve 83 has a function for switching between a pathway going from the vacuum pump 8 to the pressurizing buffer tank 81 and a pathway for releasing air coming from the vacuum pump 8 to the outside air; each of the pathways is selectable in accordance with a switch command coming from the printer control unit 200. For example, at the time of a switch to the pathway going from the vacuum pump 8 to the pressurizing buffer tank 81, air is sent to the pressurizing buffer tank 81 by the vacuum pump 8, and the pressure of the interior space of the pressurizing buffer tank 81 rises. At the time of a switch to the pathway for releasing the positive pressure coming from the vacuum pump 8 to the outside air, however, the supply of pressurization from the vacuum pump 8 to the pressurizing buffer tank 81 is stopped. A pressurizing sensor 84 is provided in order to measure the pressure inside the pressurizing buffer tank 81.

One end of a shared pressurizing pathway (piping) 85 is connected to the pressurizing buffer tank 81. The other end of the shared pressurizing pathway 85 has six branches, and each of the branching pathways functions as a pressurizing pathway 681. A three-way valve 86 is provided to the shared pressurizing path 85 and has a function for switching between a pathway from the pressurizing buffer tank 81 to each of the ink supply parts 61 and a pathway for releasing the pressurization coming from the pressurizing buffer tank 81 to the outside air; each of the pathways is selectable in accordance with a switch command coming from the printer control unit 200. For example, at the time of a switch to the pathways going from the pressurizing buffer tank 81 to each of the ink supply parts 61, the pressurization air inside the pressurizing buffer tank 81 is supplied to the respective ink supply part 61. On the other hand, at the time of a switch to the pathway for releasing the pressurization air from the pressurizing buffer tank 81 to the outside air, the supply of the pressurization air from the pressurizing buffer tank 81 to each of the ink supply parts 61 is stopped.

Figure 4A:
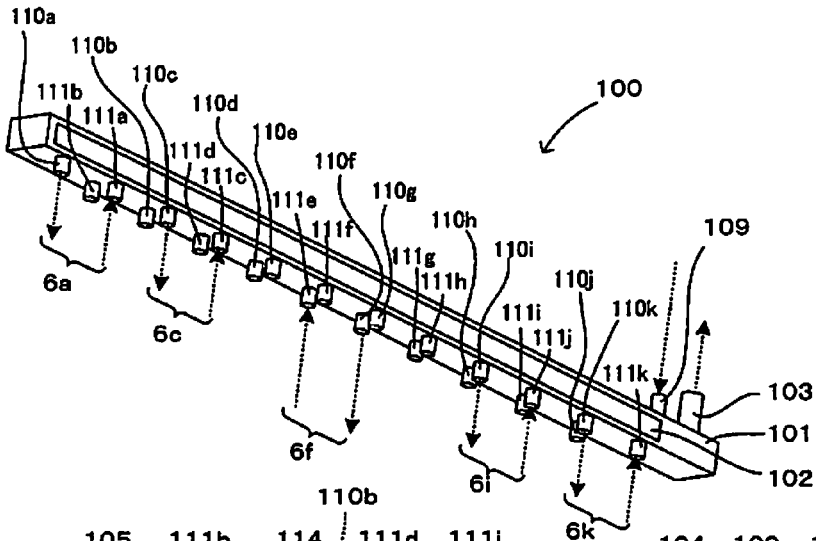
FIG. 4A is a drawing illustrating the configuration of a manifold.
Figure 4B:
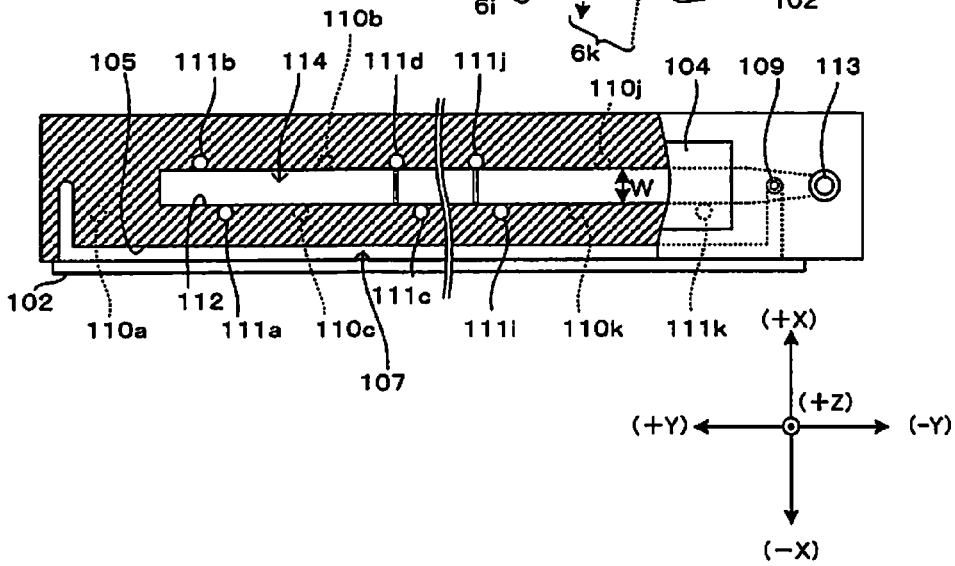
FIG. 4B is a drawing illustrating the configuration of the manifold.
Figure 4C:
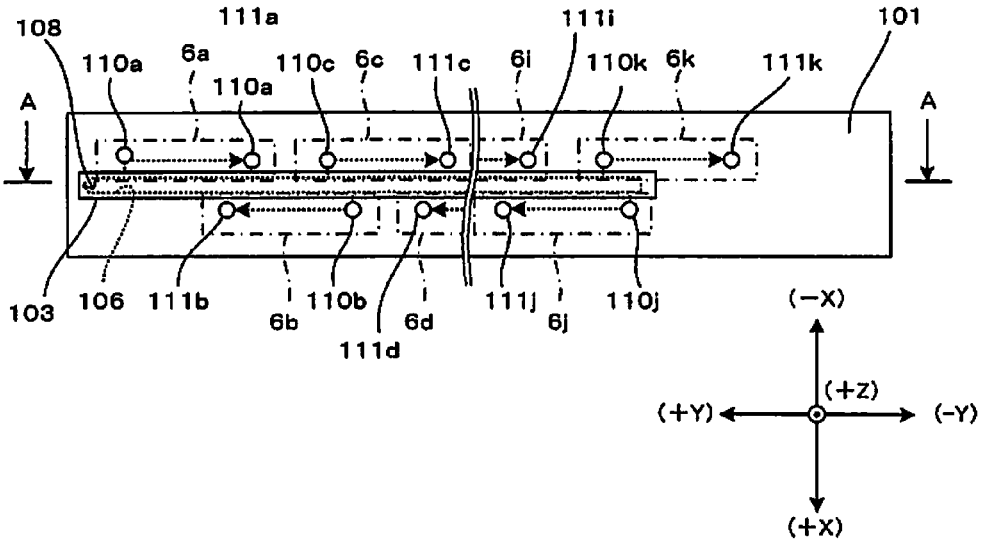
FIG. 4C is a drawing illustrating the configuration of the manifold.
Figure 5:
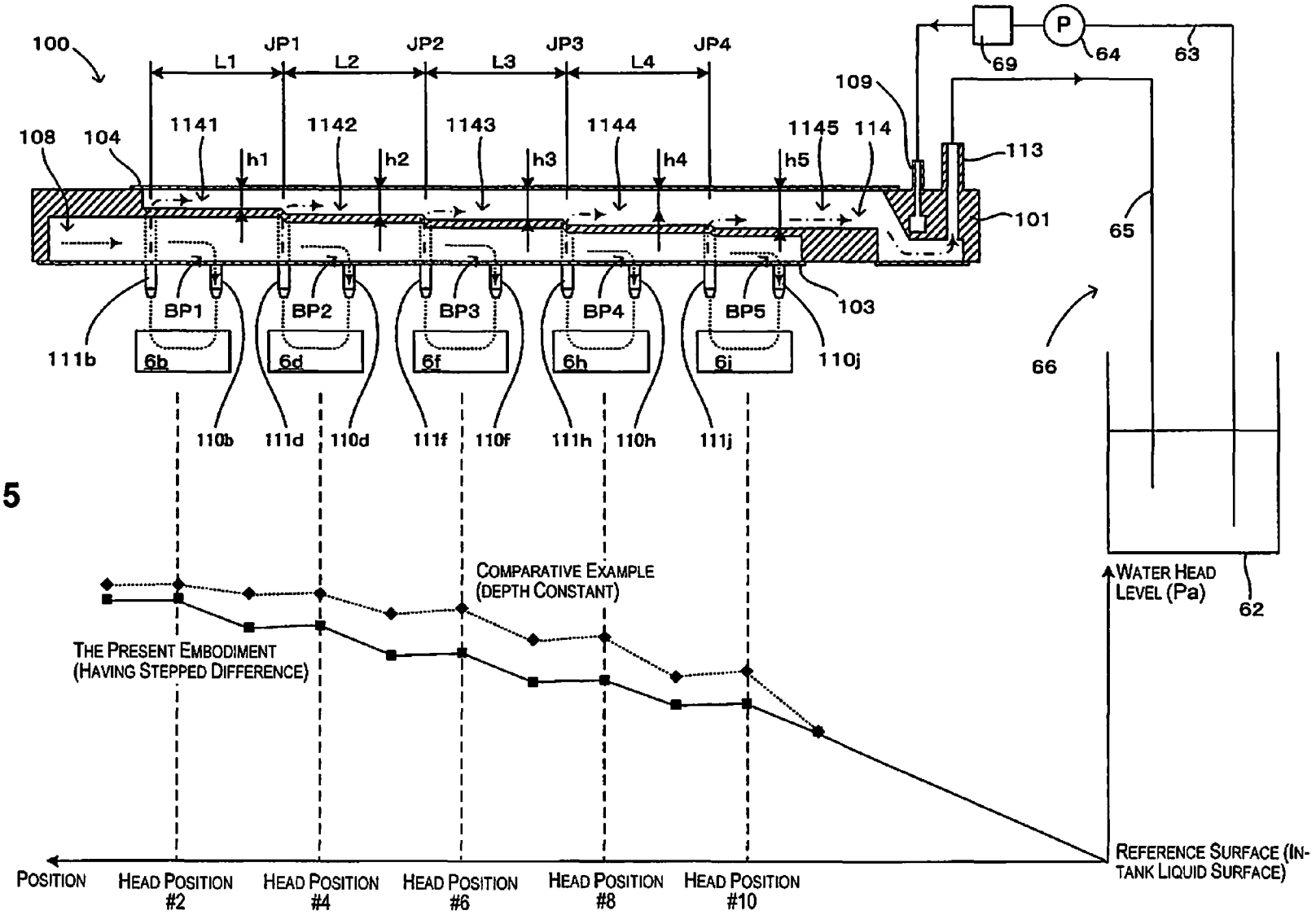
FIG. 5 is a drawing for describing the operation of a manifold.

The specific configurations and operations of the manifolds 100 shall be described next, with reference to FIGS. 3 to 5. FIG. 4A-4C are drawings illustrating the configuration of a manifold, where FIG. 4A is an external perspective view, FIG. 4B is a partial cutaway plan view, and FIG. 5C is a bottom view. A manifold 100 is provided for every color of ink but these all have the same configuration. As such, the manifold 100 for white is described below, and descriptions of the others are omitted.

This manifold 100 is provided with a main body part 101 having a slab shape, and three sheet members 102 to 104. A groove part 105 (see FIG. 4B) and a groove part 106 (see FIG. 4C) are provided in the Y-direction to an −X-side surface part and bottom surface part of the main body part 101, respectively. +Y-side end parts of the groove part 105 and the groove part 106 communicate with each other through a communication orifice (not shown) formed in the interior of the main body part 101. Also, the sheet member 102 is attached to the −X-side surface part of the main body part 101, closing off the groove part 105 and forming a supply flow path 107, as illustrated in FIG. 4B, and the sheet member 103 is attached to the bottom surface part of the main body part 101, closing off the groove part 106 and forming a supply flow path 108, as illustrated in FIG. 4C. A −Y-side end part of the groove part 105 extends in the +X-direction in the interior of the main body part 101, as illustrated in FIG. 4B, and has communication with a supply-side port 109 connected to the supply flow path 63. For this reason, ink that has been pumped to the main body part 101 via the supply flow path 63 and the supply-side port 109 flows through the supply flow paths 107, 108. These supply flow paths 107, 108 function as a "supply path" of the invention.

The groove part 106 has communication with a proximal end part (i.e., a +Z-side end part) of 11 supply pipings 110*a* to 110*k*. A distal end part (i.e., a −Z-side end part) of the supply pipings 110*a* to 110*k* extends toward a respectively corresponding head 6, making respective one-to-one connections. As such, ink flowing through the supply flow path is respectively branched at the supply pipings 110*a* to 110*k* and supplied to the corresponding head 6. In this manner, in the present embodiment, 11 of the heads 6 are provided as heads for ejecting the white ink. Therefore, to make a distinction between each of the heads 6, the head 6 positioned most to the +Y-direction side is called a "head 6*a*", and the heads 6 positioned successively more to the −Y-direction side are called a "head 6*b*" to "head 6*k*", respectively. The positions of the heads 6*a* to 6*k* in the Y-direction are understood to be a "head position #1" to "head position #11", respectively. A head column where the six heads 6*a*, 6*c*, 6*e*, 6*g*, 6*i*, and 6*k* are arranged side by side in the Y-direction at a certain pitch is constituted, as is a head column where the remaining heads 6*b*, 6*d*, 6*f*, 6*h*, and 6*j* are arranged side by side in the Y-direction at a certain pitch. The two of these head columns are then arranged in the X-direction in a state of having been shifted in the Y-direction relative to one another by half the amount of pitch.

Respectively connected to each of the heads 6*a* to 6*k* are distal end parts of recovery pipings 111*a* to 111*k* for recovering to the manifold 100 the ink that is recovered from the relevant head. The recovery pipings 111*a* to 111*k* have communication with a groove part 112 formed on an upper surface part of the main body part 101, passing through the interior of the main body part 101. This groove part 112 extends in the Y-direction at a length (width) W in the X-direction. Now, in the present embodiment, as shall be described below, the groove part 112 is finished so that the depth thereof increases in a stepwise manner going forward in the −Y-direction. The reason for this shall be described below in greater detail with reference to FIG. 5.

The −Y-direction end part of the groove part 112 configured in this manner extends further in the −Y-direction through the interior of the main body part 101, and has communication with a recovery-side port 113 connected to the recovery flow path 65. A site of the groove part 112 that is upwardly opened is blocked off with the sheet member 104 (FIG. 5), and this forms a recovery pathway 114. As such, ink that is recovered from the heads via each of the recovery pipings 111*a* to 111*k* is merged on the recovery pathway 114, and returned to the tank 62 via the recovery-side port 113 and the recovery flow path 65. In this manner, in the present embodiment, the recovery pathway 114 functions as a "recovery path" of the invention.

The ink supply and recovery operations in the manifold 100 shall be described next, with reference to FIG. 5. FIG. 5 is a drawing for describing the operation of the manifold, and the cross-sectional structure in FIG. 5 illustrates a structure viewed along the A-A line of FIGS. 4A-4C. To facilitate understanding of the operation on the basis of FIG. 5, the supply and recovery of ink at the heads 6*b*, 6*d*, 6*f*, 6*h*, and 6*j* constituting the +X-side head column shall be described, but the same is also entirely true also of the −X-side head column.

When ink is pumped from the tank 62 to the main body part 101 of the manifold 100 via the supply flow path 63 and the supply-side port 109, then the ink flows through the supply flow paths 107, 108. At the position of connection between the supply flow path 108 and the supply piping 110*b*, i.e., a branching point BP1, some of the ink that is supplied from the tank 62 is branched off and supplied to the head 6*b* via the supply piping 110*b*. In turn, the remaining ink flows through the supply flow path 108 from the branching point BP1 and, at the next branching point (a position connected to the supply flow path 108 and the supply piping 110*d*) BP2, some of the ink is again branched off and supplied to the head 6*d* via the supply piping 110*d*. The ink carries on being supplied to each of the heads 6*f*, 6*h*, and 6*j* while repeating the branched supply operation of such description.

Ink that is recovered from the head 6*b*, however, is made to flow into the recovery pathway 114 by the recovery piping 111*b*, and flows through the inside of the recovery pathway 114 toward the tank 62. This ink merges with ink recovered from the head 6*d* at a position of connection between the recovery pathway 114 and the recovery piping 111*d*, i.e., a merging point JP1. From this merging point JP1, the ink recovered from the head 6*b* and the ink recovered from the head 6*d* further flow together toward the tank 62 through the inside of the recovery pathway 114. A merging operation of such description is executed at a position of connection between the recovery pathway 114 and the recovery piping 111*f* (a merging point JP2), a position of connection between the recovery pathway 114 and the recovery piping 111*h* (a merging point JP3), and a position of connection between the recovery pathway 114 and the recovery piping 111*j* (a merging point JP4). Then, the recovered ink that has flowed as far as the recovery-side port 113 via the recovery pathway 114 is returned to the tank 62 via the recovery flow path 54.

In the present embodiment, as stated above, the groove part 112 grows increasingly deeper in a stepwise manner going forward in the −Y-direction. More specifically, as illustrated in FIG. 5, of the recovery pathway 114, a recovery path part 1141 more to the +Y-side than the merging point JP1 is shallowest, and at the merging point JP1 the depth changes from a depth h1 to a depth h2 (>h1), thus forming a stepped difference at the merging point JP1. Also, the depth remains constant and unchanged from the depth h2 at, of the recovery pathway 114, a recovery path part 1142 going as far as the next merging point JP2 from the merging point JP1, but at the merging point JP2 the depth changes from the depth h2 to a depth h3 (>h2), thus forming a stepped difference also at the merging point JP2. The same is also true of successive recovery path parts 1143 to 1145.

Thus, at each of the merging points JP1 to JP4, the depth of the recovery path part located further downstream than the relevant merging point is deeper than the depth of the recovery path part located on the upstream side, and the cross-sectional area of the downstream recovery path part is greater than the cross-sectional area of the upstream recovery path part. As such, the following actions and effects are obtained. Namely, because at the relevant merging point the recovered ink is merged into the ink that has flowed through the upstream recovery path part, the flow rate of the liquid flowing through the downstream recovery path part is greater than the flow rate of the liquid flowing through the upstream recovery path part. Herein, in a case where the two recovery path parts are of the same depth (a comparative example in FIG. 5), then a flow path resistance R of each of the recovery path parts will have the same value. That is to say, the following formula $$R = \frac{8\mu L(W+h)^2}{W^3h^3}\,[\mathrm{Pa\cdot s/m^3}]$$

makes it possible to find the flow path resistance R. μ in the formula is the viscosity of the ink, and L is the length of the recovery path parts in the direction of flow of the ink.

In the present embodiment, the recovery pipings are also arranged at equal pitch so as to correspond to the arranging of the heads at equal pitch, the equations $$L=L1=L2=L3=L4$$

hold true. The width W is also constant. As such, the flow path resistance R of each of the recovery path parts will be the same when the upstream recovery path part and the downstream recovery path part are the same depth. Therefore, in the comparative example, there are large fluctuations in the pressure in the heads 6 that lead to the downstream recovery path part; as illustrated with the dotted line in FIG. 5, there are changes within a comparatively broad pressure range to the water head value imparted to the meniscus of the nozzles of each of the heads 6, due to the water head difference with the ink liquid surface inside the tank 62.

By contrast, in the present embodiment, having the downstream recovery path part be deeper than the upstream recovery path part at all of the merging points JP1 to JP4 reduces the flow path resistance in the downstream recovery path part. For this reason, the fluctuations in pressure described above are curbed. As a result, the water head value imparted to the meniscus of the nozzles of each of the heads 6 changes within a narrower pressure range than the comparative example, and the pressure is successfully evened.

In the embodiment described above, each of the recovery path parts 1141 to 1145 is given a constant cross-sectional area in the direction of flow in the relevant recovery path part, and a stepped difference is formed at each of the merging points JP1 to JP4. For this reason, at each of the stepped difference portions, the ink flow changes greatly and disturbed. This disturbance of the ink flow makes it possible to stir the ink components. In particular, the white ink contains a substance that is highly settleable, and therefore the above-described disturbance makes it easier to recover the settling, and employing the stepped difference configuration for the white ink manifold 100 is preferable in terms of curbing nozzle clogging and the like.

In the embodiment described above, a configuration similar to that of the recovery side, as illustrated in FIG. 5, is also employed on the supply side. At each of the branching points BP1 to BP4 in the supply flow path 108, the relevant branching position is given a different height at the upstream supply path part located on the upstream side and the downstream supply path part located on the downstream side, thus changing the flow path resistance. This is a configuration that is employed in order to address the changes in flow rate of the ink before and after passage through each of the branching points BP1 to BP. That is to say, the flow rate of ink flowing through the downstream supply path part is reduced commensurate with the amount that is branched at the branching points and supplied to the heads 6. Therefore, causing the downstream supply path part to be lower than the upstream supply path part causes the cross-sectional area of the downstream supply path part in the direction of flow of the ink to be smaller than the cross-sectional area of the upstream supply path part. This raises the flow path resistance of the downstream supply path part so as to correspond with the reduction in the ink flow rate, thus making it possible to further even the pressure imparted to each of the heads 6.

Furthermore, in the present embodiment, as illustrated in FIG. 5, the direction of flow of the ink in the supply flow path 108 and the direction of flow of the ink in the recovery pathway 114 are matched together. Then, stepwise lowering of the height of the supply flow path 108 in the direction of flow of ink and stepwise deepening of the recovery pathway 114 in the direction of flow of ink are combined together. As such, it becomes possible to make the manifold 100 thinner.

In this manner, in the present embodiment, the upstream supply path part and the downstream supply path part correspond to a "first supply path part" and "second supply path part" of the invention, respectively. The upstream recovery path part and the downstream recovery path part correspond to a "first recovery path part" and "second recovery path part" of the invention, respectively, and the recovery path part further downstream than the downstream recovery path part corresponds to a "third recovery path part" of the invention.

The invention is not intended to be limited to the embodiment described above, but rather the elements of the embodiment described above can undergo combinations as appropriate or a variety of modifications provided that there is no departure from the spirit of the invention. For example, in the embodiment described above, each of the recovery path parts 1141 to 1145 was given a constant cross-sectional area in the direction of flow of the ink in the relevant recovery path part, but the configuration may also be such that a bottom surface of each of the recovery path parts 1141 to 1145 is made to be an inclined surface and the cross-sectional area increases going in the direction of flow of the ink. In this regard, the same is also true of the supply path part side, and the configuration may be such that a ceiling surface of each of the supply path parts is made to be an inclined surface and the cross-sectional area decreases going in the direction of flow of the ink.

Also, in the embodiment described above, the cross-sectional area of the downstream recovery path part is made to be deeper than the upstream recovery path part in order to cause the cross-sectional area of the downstream recovery path part to be greater than the cross-sectional area of the upstream recovery path part, but adjustments may also be made with the width of the recovery path parts either instead of the depth or along with the depth. In other words, the cross-sectional area of the downstream recovery path part may be made to be greater than the cross-sectional area of the upstream recovery path part by causing the downstream recovery path part to be wider than the upstream recovery path part. Here, in consideration of making the recovery path parts 1141 to 1145 in the manifold 100 easier to mold or improve the precision of molding thereof, it would be desirable to have either the width or the depth be equal and have the other be mutually different. In this regard, the same is also true of the supply path part.

In the embodiment described above, there was understood to be one tank 62, but there may be a plurality, such as two, of the tanks 62. In a case where there are a plurality of tanks, then there should be a flow path that creates communication between the plurality of tanks. In such a case, the plurality of tanks and the flow path creating communication between the tanks would together be understood to be a "retaining part".

In the embodiment described above, the direction of flow of the ink inside the heads 6*b*, 6*d*, 6*f*, 6*h*, 6*j* that constitute the +X-side head column and the direction of flow of the ink inside the heads 6*a*, 6*c*, 6*e*, 6*g*, 6*i*, 6*k* that constitute the −X-side head column were mutually opposite directions, but the direction of the flow of the ink inside the heads is arbitrary and the configuration may be such that all have the same direction.

It would also be possible to modify as appropriate the arrangement or number of the heads 6 and the UV lamps, and possible to modify the shape or the like of the platen 30 as appropriate. It is further possible to modify as appropriate the specific configurations of each of the parts of the printer 1; for example, the configuration of the heads 6 may be modified from what is described above.

In the embodiment described above, the invention was employed for a printer of an inkjet format using UV inks, but a liquid ejecting apparatus that ejects or discharges another liquid other than UV ink may also be employed. The invention could be appropriated for a variety of liquid ejecting apparatuses provided with a liquid ejecting head for discharging minute liquid droplets, or the like. The phrase "liquid droplets" refers to the state of a liquid that is discharged from the liquid ejecting apparatus, and is understood to also include a liquid that leaves a particulate, tear-shaped, or filamentous trail. The phrase "liquid" as mentioned here should be such a material as to be possible for a liquid ejecting head to eject. For example, the substance need only be the state of when in a liquid phase, and encompasses not only fluids such as high- or low-viscosity liquids, sols, gel waters, and other inorganic solvents, organic solvents, solutions, liquid-state resins, liquid metals (metal melts), and liquids serving as one state of a substance, but also solvents into which a functional material composed of a solid matter such as a pigment or metal particles has been dissolved or dispersed, or the like. Representative examples of liquids could include an ink such as was described in the embodiment above, a liquid crystal, or the like. Here, "ink" encompasses a variety of liquid compositions, such as typical water-based inks and oil-based inks as well as gel inks, hot melt inks, or UV-curable inks. Other specific examples of the liquid ejecting apparatus may include: a liquid ejecting apparatus for ejecting a liquid containing, in the form of a dispersion or solution, a material such as an electrode material or color material that is used, inter alia, in the manufacture of liquid crystal displays, electroluminescence (EL) displays, surface emitting displays, or color filters; a liquid ejecting apparatus for ejecting a biological organic matter used to manufacture biochips; a liquid ejecting apparatus for ejecting a liquid serving as a sample, used as a precision pipette; or printing device, a micro-dispenser, or the like. The invention may moreover be employed in: a liquid ejecting apparatus for ejecting a lubricant at pin points for a precision machine such as a timepiece or camera; a liquid ejecting apparatus for forming, inter alia, a hemispherical micro lens (optical lens) used in an optical communication element or the like; a liquid ejecting apparatus for ejecting an acid or alkali etching solution in order to etch a substrate or the like; or a liquid ejecting apparatus for printing, with which a liquid is ejected onto a fabric or the like. The invention can be applied to any one of these types of liquid ejecting apparatuses.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A liquid ejecting apparatus, comprising:

a retaining part configured to retain a liquid;

a first and second heads configured to eject the liquid; and a liquid circulation part where the liquid flows from the retaining part through an inside of the first head to the retaining part, and where the liquid passes from the retaining part through an inside of the second head to the retaining part;

the liquid circulation part including a recovery path where the liquid that has flowed inside one of the first head and the second head flows to the retaining part, the recovery path having a first merging point where the liquid that has flowed inside the first head and the liquid that has flowed inside the second head merge together, a first recovery path part where the liquid that has flowed inside the first head flows to the first merging point, and a second recovery path part where the liquid that has flowed inside the first head and the liquid that has flowed inside the second head flows from the first merging point, a cross-sectional area of the second recovery path part, which is orthogonal to a direction of flow of the liquid at the second recovery path part, being greater than a cross-sectional area of the first recovery path part, which is orthogonal to a direction of flow of the liquid at the first recovery path part.

2. The liquid ejecting apparatus according to claim 1, further comprising a third head configured to eject the liquid, in the liquid circulation part, the liquid that has flowed inside the third head passing through the recovery path to the retaining part, the recovery path having a second merging point where the liquid has flowed inside the first head and the liquid that has flowed inside the second head, and the liquid has flowed inside the third head merge together, and a third recovery path part where the liquid has flowed inside the first head, the liquid that has flowed inside the second head, and the liquid that has flowed inside the third head flows from the second merging point, a cross-sectional area of the third recovery path part, which is orthogonal to a direction of flow of the liquid at the third recovery path part, being greater than the cross-sectional area of the second recovery path part, which is orthogonal to the direction of the flow of the liquid at the second recovery path part.

3. The liquid ejecting apparatus according to claim 1, wherein the first and second recovery path parts have cross-sections orthogonal to the directions of the flow of the liquid at the first and second recovery path parts, respectively, and the cross-sections of the first and second recovery path parts have either same widths and different depths, or different widths and same depths, respectively, thereby causing the first and second recovery path parts to have different cross-sectional areas.

4. The liquid ejecting apparatus according to claim 1, wherein the first and second recovery path parts have constant cross-sectional areas in the directions of flow of the liquid at the first and second recovery path parts, respectively, and a stepped difference is formed at the first merging point.

5. The liquid ejecting apparatus according to claim 1, wherein the first and second recovery path parts have the cross-sectional areas that increase continuously in the direction of flow of the liquid at the first and second recovery path parts, respectively.

6. The liquid ejecting apparatus according to claim 1, wherein the liquid circulation part has a supply path configured to supply the liquid to the first head and the second head from the retaining part, the supply part has a first branching point configured to branch the liquid being supplied to the first head from the liquid being supplied from the retaining part, a first supply path part configured to cause the liquid to flow to the first branching point, and a second supply path part configured to cause the liquid that is not branched at the first branching point to flow from the first branching point, and a cross-sectional area of the second supply path part, which is orthogonal to the flow of the liquid at the second supply path part, is smaller than a cross-sectional area of the first supply path part, which is orthogonal to the flow of the liquid at the first supply path part.

7. The liquid ejecting apparatus according to claim 1, further comprising a first recovery piping disposed between the first head and the first recovery path part and configured to communicate a flow of the liquid that has flowed inside the first head from the first head to the first recovery path part, and a second recovery piping disposed between the second head and the second recovery path part and configured to communicate a flow of the liquid that has flowed inside the second head from the second head to the second recovery path part, the second recovery piping being different from the first recovery piping.

* * * * *